US005896621A

United States Patent [19]

Lindgren

[11] Patent Number: 5,896,621

[45] Date of Patent: Apr. 27, 1999

[54] TOOL HANDLE

[75] Inventor: Mats Lindgren, Vikmanshyttan, Sweden

[73] Assignee: AB Kompositprodukter Vikmanshyttan, Vikmanshyttan, Sweden

[21] Appl. No.: 08/836,648

[22] PCT Filed: Nov. 8, 1995

[86] PCT No.: PCT/SE95/01325

§ 371 Date: May 5, 1997

§ 102(e) Date: May 5, 1997

[87] PCT Pub. No.: WO96/14188

PCT Pub. Date: May 17, 1996

[30] Foreign Application Priority Data

Nov. 8, 1994 [SE] Sweden ..... 9403842

[51] Int. Cl.[6] ..... B26D 1/12

[52] U.S. Cl. ..... 16/114 R; 407/29.15

[58] Field of Search ..... 16/110 R, 111 R, 16/114 R; 279/102; 407/29.15; 81/489; 451/514

[56] References Cited

U.S. PATENT DOCUMENTS

| | | | |
|---|---|---|---|
| 191,811 | 6/1877 | Nicholson | 407/29.15 |
| 380,660 | 4/1888 | Prankard | 407/29.15 |
| 1,436,556 | 11/1922 | Woodworth | 279/102 |
| 2,229,453 | 1/1941 | Heuer | 407/29.15 |
| 2,388,920 | 11/1945 | Jaynes | 407/29.15 |
| 2,435,654 | 2/1948 | Pleva | 279/102 |

*Primary Examiner*—Chuck Y. Mah
*Assistant Examiner*—Donald M. Gurley
*Attorney, Agent, or Firm*—Sughrue, Mion, Zinn, Macpeak & Seas, PLLC

[57] ABSTRACT

A handle for hand-held tools, particularly files, that have an end portion (3) for insertion into the handle (1). The handle includes at least two parts (4, 5) which are separated in the insertion direction of the end portion of the tool and includes end-portion guides (6). One guide has the form of a hole (6) in one handle part (4). A surface on the guide in the other handle part (5) intended for coaction with the end portion (3) of the tool is displaced laterally in relation to a corresponding surface in the hole (6). The two handle parts (4, 5) are resiliently movable relative to one another, to permit reduction in the displacement between the surfaces in conjunction with inserting the end portion (3) of the tool into the handle (1). The end portion of the tool is automatically clamped firmly in the handle as the handle parts tend to spring back to their original positions.

9 Claims, 2 Drawing Sheets

1
2
3
4
5
6
7
8
9
10
14
A

TOOL HANDLE

BACKGROUND OF THE INVENTION

The present invention relates to handles for hand-held tools and then particularly, but not exclusively, for files of the kind provided with a tang which is inserted into the handle, said handle including at least two parts which are separated in the tang-insertion direction and provided with tang guide means.

Several different designs of handles for hand-held files and like tools are known to the art. The majority of these handles fall into the following two main types.

The first and the simplest type of handle includes an axially extending hole or passage into which the file tang is pressed. The file tang is normally provided with a slightly conical, four-cornered attachment means. The handle thus has the simplest conceivable design, which enables it to be manufactured at low cost. One drawback with handles of this design, however, is that the handle cannot always be relied upon to grip the file firmly, and there is a risk of the file loosening in the handle and sliding therefrom while being used. This drawback has become particularly pronounced with handles that are made of plastic material, as is now more usually the case, which generates a low coefficient of friction between file and handle.

In the case of handles that belong to the second main type or category, the axially extending hole intended to receive the file tang is surrounded by thin, resilient jaws. The tang has a screw-threaded part and when the file has been inserted into the handle a nut is fitted over the file and tightened on the screw-threaded part of the tang. The resilient jaws are therewith pressed against the file and hold the file firmly in the handle. Manufacture of this handle, however, is a complicated process and the cost of manufacture is commensurately high.

U.S. Pat. No. 1,436,556 describes a file handle comprised of two halves of a metal shell which are pressed one against the other. Each shell half has cut therefrom two tongues which are pressed into the handle. By pressing the two shell halves together, a file can be inserted into the shaft and clamped firmly between said tongues, due to a tendency of the shell halves to spring back.

In addition to the manufacture of this handle being relatively complicated, another serious drawback with this known handle is that as the file is used it tends to loosen in the handle as a result of the workman involuntarily squeezing together the two handle halves with his/her hand during a working operation.

SUMMARY OF THE INVENTION

The main object of the present invention is to provide a handle for hand-held tools which avoids the aforesaid problems and which can be manufactured in a highly rational manner in one single piece.

According to the present invention, a handle of the kind described in the first paragraph is characterized in that one guide means has the form of a hole in the one handle part, and that a guide surface in the other handle part intended for coaction with the tang of the file is displaced transversely in relation to a corresponding surface in said hole; and in that the two handle parts are resiliently movable in relation to one another so as to permit a reduction in the displacement between said surfaces as the tang is inserted into the handle.

A handle of this kind can be manufactured from a suitable plastic material in a simple plastic tool. A tool inserted into the handle will be securely held therein during a working operation, by virtue of the fact that the forces which secure the tool in the handle increase as the tool is pressed against the workpiece in the intended direction. The tool can be released easily from the handle, by pressing one of said handle parts in the direction opposite to the direction in which it is pressed during a working operation.

BRIEF DESCRIPTION OF THE FIGURES

The invention will now be described in more detail with reference to exemplifying embodiments thereof and also with reference to the accompanying drawings, in which.

DETAILED DESCRIPTION OF THE PREFERRED EMBODIMENTS

Figures 1, 2, 3:
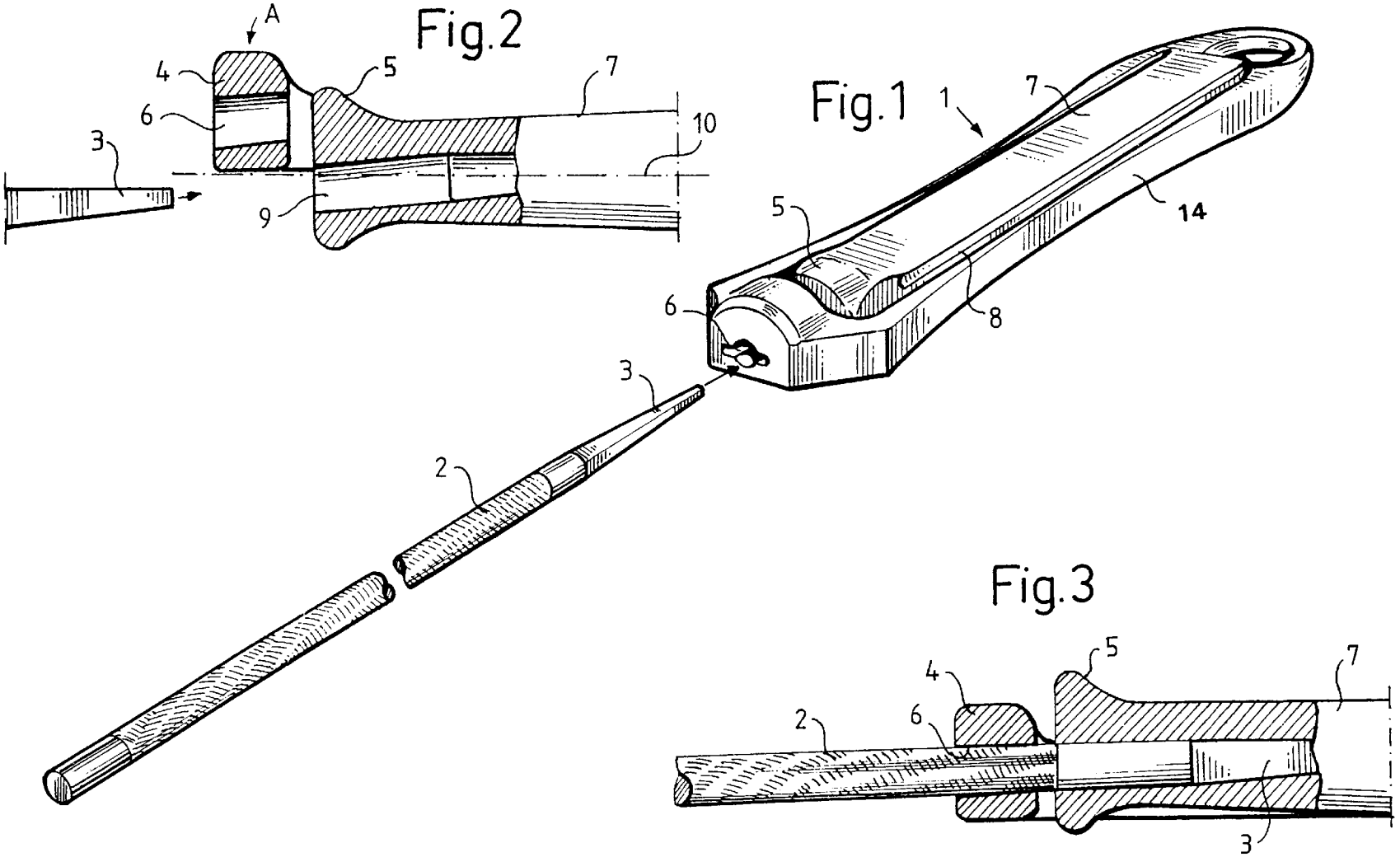
FIG. 1 illustrates a first embodiment of a file handle during insertion of a file thereinto.
FIG. 2 is a partial sectioned view of the front end of the handle and shows the two parts of the handle in a starting position.
FIG. 3 is a partially sectioned view of the front end of the handle with a file inserted therein.

The file handle 1 shown in FIG. 1 is a one-piece structure made from a suitable plastic material, such as acetal plastic, which retains good spring properties even after having been used for a long period of time. In the illustrated case, the handle is intended to receive a round file 2 having a tapered tang 3.

The handle includes a front part 4 and a rear part 5, as seen in the file insertion direction. In the case of this embodiment, both parts include a hole 6, 9, see FIG. 2, in which the tang is received, wherein the walls of said holes form guide surfaces therefor. The holes have a configuration which will suit both round files and flat files.

The front part 4 of the handle 1 forms the front part of a frame-like portion 14 which surrounds a tongue 7 whose forward part forms the rear handle part as seen in the file insertion direction. The tongue 7 is separated from the frame 6 by means of a U-shaped slot 8, with the exception of the base part of the tongue 7 which merges directly with the frame part 14. As a result of the elasticity of the plastic material, the handle parts 4 and 5 can be moved relative to one another in a direction generally perpendicular to the file insertion direction.

Prior to inserting the file, the part 4 is displaced laterally in relation to the part 5, and the hole 6 provided in the part 4 will not therefore be in line with the hole 9 provided in the part 5, see FIG. 2.

In order to enable the tang 3 to be inserted into the holes 6 and 9, the handle part 4 is pressed down in the Figure with a force A, or alternatively the handle part 5 is pressed up. Whatever the procedure adopted, the parts 4 and 5 are moved relative to one another so as to bring the holes 6 and 9 into mutual alignment so that the tang 3 can be inserted.

When the force A is removed, the part 4 will strive to return to its original starting position relative to the part 5, therewith firmly clamping the file 2 and holding the file securely in the handle, see FIG. 3. This file-holding force is increased when the file can be inserted into the handle to such an extent that a part of its cutting surface is located in the hole 6 in the front part of the handle, since this will increase the friction between the file and the coacting guide surface in the hole 6.

When the handle is used in the position illustrated in FIG. 1, the force by which the file is held in the handle will be further increased by virtue of a force that acts upwardly as the file is pressed against the surface of a workpiece. The file thus generates a self-locking action.

As will be evident from FIG. 2 for instance, the hole 9 is not parallel with the longitudinal centre line 10 of the handle 7. The angle of the hole to the centre line is such as to enable the tool used to form the hole in the handle during its manufacture to be withdrawn in the longitudinal direction of said hole without being obstructed by the handle part 4. In order to simplify the process of manufacture of both the hole-forming tool and the handle, the hole 6 may also define a corresponding angle with the longitudinal axis of the handle.

Since the tang 3 of the file 2 tapers conically, the longitudinal axis of the file will adopt a certain angle to the longitudinal axis of the hole 9 as a result of the upwardly acting force exerted on the tang 3 by the handle part 4. This means that in practice the longitudinal axes of the file and the file handle will essentially coincide, see FIG. 3.

The hole 6 in the part 4 may be slightly conical, thereby obtaining a greater edge pressure against the file 2 at the inner edge of the hole, which further enhances the force with which the file is held. The hole 9 may also be slightly conical.

The file can be released from the handle, simply by pressing the handle part 4 downwards so as to bring the holes 6 and 9 into mutual alignment.

Figure 4:
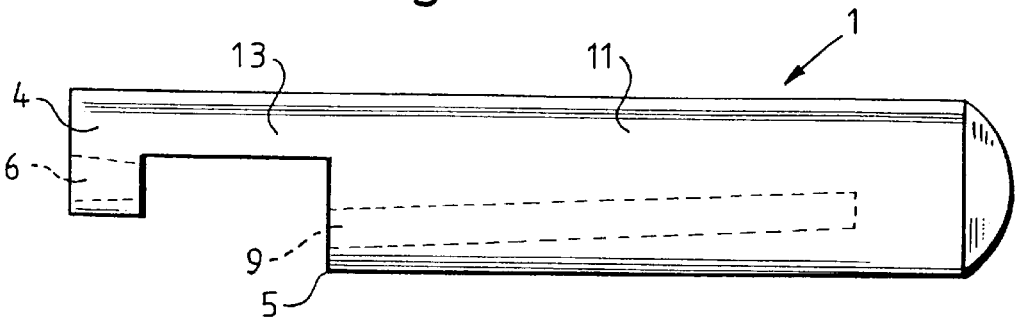
FIGS. 4 and 5 are respective schematic views of a second embodiment of an inventive handle prior to and after inserting a file thereinto.

FIG. 4 illustrates a simplified handle 1 in which the resilient handle part 4 projects out in the form of a tongue 13, forwardly of the main handle part 11 provided with the hole 9.

Figure 5:
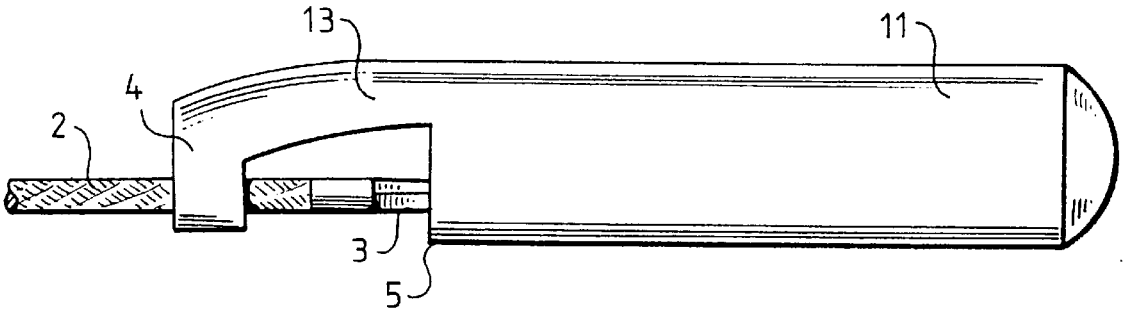

In order to enable a file 2 to be inserted into the handle, it is necessary to bend the tongue 13 downwards so as to bring the holes 6 and 9 into mutual alignment, as illustrated in FIG. 5. When the force exerted on the tongue 13 is relieved, the tongue will strive to return to its original position and therewith clamp the file 2 firmly in the handle.

Figure 6:
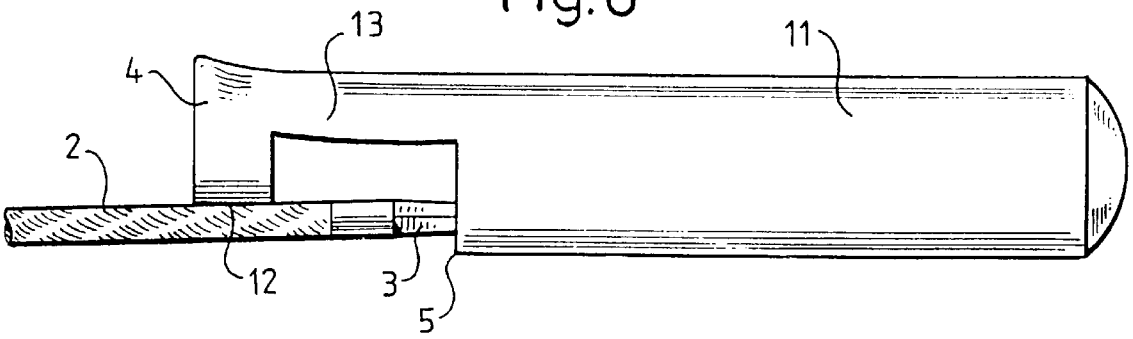
FIG. 6 is a schematic view of a third embodiment of an inventive handle after having inserted a file thereinto.

FIG. 6 illustrates an alternative embodiment in which the part 4 is provided with an open guide surface 12 for coaction with the file 2, instead of having a through-penetrating hole. In the case of this embodiment, the handle part 4 covers the hole in the main handle part 11 when in its starting position. When wishing to insert the file 2 into the handle, it is necessary to press the tongue 13 upwards so that the file can be inserted, whereafter the tongue is released and allowed to return to its original position in which the file is pressed firmly in the handle.

In the case of the illustrated embodiments, the rear hole is not a through-penetrating hole, meaning that the inner end of the file lies protected in the hole. This eliminates the risk of damage to the hand of the workman, for instance should the workman fall while holding the file in his/her hand.

However, it is feasible to provide the handle with an open rear guide, provided that the guide provided in the front handle part 4 has the form of a relatively long hole or the like.

Although the invention has been described above with reference to a number of embodiments thereof, it will be understood that modifications can be made in several respects without departing from the described tool-clamping principle. It will also be understood that an inventive handle can be used with hand-held tools other than files, the shape of the handle being adapted to the use concerned.

I claim:

1. A handle for hand-held tools, particularly files, that comprise an end portion (3) for insertion into the handle (1), wherein;

a) the handle includes at least two parts (4, 5) which are separated in a tool insertion direction and which are individually provided with guides (6, 9; 12, 9) for the tool end portion;

b) a first guide comprises a hole (9) provided in one handle part (5);

c) a guide surface in the other handle part (4) intended for coaction with the tool end portion is displaced laterally in relation to a corresponding guide surface in said hole when the handle is in a relaxed condition with no tool inserted therein;

d) the two handle parts are resiliently movable in relation to one another to permit a reduction of the displacement between said surfaces in conjunction with inserting the tool end portion into the handle;

e) the lateral displacement in the relaxed condition is sufficient to prevent the insertion of the tool end portion: and f) the resiliency of the two handle parts alone and exclusively provides sufficient force to firmly grip and retain the inserted tool end portion.

2. A handle according to claim 1, wherein both guides have the form of holes in respective handle parts.

3. A handle according to claim 2 wherein the holes taper in the tool insertion direction.

4. A handle according to claim 1 wherein the first guide, seen in the insertion direction, is a blind hole for receiving the tool end portion.

5. A handle according to claim 1, wherein the handle is a one-piece structure, and the handle part having the first guide, seen in the insertion direction, has the form of a resilient tongue (7).

6. A handle according to claim 4, wherein the tongue is positioned centrally in the handle and is separated from the other handle part (6) which surrounds the tongue in the form of a frame-like part by a slot (8) with the exception of a base of the tongue which merges directly with the frame-like part.

7. A handle according to claim 1, wherein the handle is a one-piece structure, and the other handle part (4) having the guide surface (6), seen in the tool insertion direction, has the form of a resilient tongue (13) which projects forwardly from the first part (11) of the handle.

8. A handle according to claim 1 wherein the guide surfaces coacting with the tool end portion define a small angle with an axial centre line of the handle.

9. A handle according to claim 1 wherein the handle is made of a resilient plastic material.

* * * * *